US007648422B2

(12) United States Patent
Brooks et al.

(10) Patent No.: US 7,648,422 B2
(45) **Date of Patent: *Jan. 19, 2010**

(54) GOLF SWING TRAINING DEVICE

(75) Inventors: Patrick H. Brooks, Centreville, VA (US); Chris A. Ries, Alexandria, VA (US); Roy T. Phillips, Fairfax, VA (US)

(73) Assignee: Fairway Golf Center, LLC, Centreville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/976,694

(22) Filed: Oct. 26, 2007

(65) Prior Publication Data

US 2008/0182678 A1 Jul. 31, 2008

Related U.S. Application Data

(60) Provisional application No. 60/898,399, filed on Jan. 31, 2007.

(51) Int. Cl.
*A63B 69/36* (2006.01)

(52) U.S. Cl. ..... 473/215; 473/226

(58) Field of Classification Search ..... 473/207–226, 473/266, 276

See application file for complete search history.

(56) References Cited

U.S. PATENT DOCUMENTS

| | | | | |
|---|---|---|---|---|
| 1,962,256 | A | 6/1934 | Nelson et al. | |
| 2,103,502 | A | 12/1937 | Webster | |
| 3,680,869 | A | 8/1972 | Brady | |
| 3,804,420 | A * | 4/1974 | Boyd | 473/212 |
| 3,861,688 | A | 1/1975 | Butler | |
| 4,135,714 | A * | 1/1979 | Hughes | 482/127 |
| 4,181,310 | A * | 1/1980 | Boehmer | 473/215 |
| 4,714,244 | A * | 12/1987 | Kolomayets et al. | 482/72 |
| 4,991,850 | A | 2/1991 | Wilhlem | |
| 5,318,491 | A * | 6/1994 | Houston | 482/54 |
| 5,423,547 | A | 6/1995 | Puso | |
| 5,439,214 | A | 8/1995 | Dalbo | |
| 5,486,149 | A * | 1/1996 | Smith et al. | 482/120 |
| 5,697,572 | A | 12/1997 | Salentine et al. | |
| 5,816,928 | A * | 10/1998 | Colonna | 473/229 |
| 5,871,406 | A | 2/1999 | Worrell | |
| 5,879,240 | A | 3/1999 | Stuart | |
| 5,938,137 | A * | 8/1999 | Poulson | 242/379.2 |
| 6,149,559 | A * | 11/2000 | Mackey | 482/124 |
| 6,270,430 | B1 | 8/2001 | Nicoloff | |
| 6,413,196 | B1 * | 7/2002 | Crowson | 482/118 |
| 6,458,036 | B1 | 10/2002 | Gutierrez | |
| 6,591,461 | B2 | 7/2003 | Salentine et al. | |
| 6,659,922 | B1 | 12/2003 | Yu | |
| 6,800,035 | B1 | 10/2004 | Couch | |

(Continued)

*Primary Examiner*—Nini Legesse
(74) *Attorney, Agent, or Firm*—KED & Associates, LLP

(57) ABSTRACT

A golf training device is provided that includes a cord (flexible member) and a connecting device attached to one end of the cord to connect to a golf club, to a golfer's hand and/or to a golfer's finger. A housing may house the cord when the cord is in a retracted state, and the housing may allow the cord to extend therefrom based on movement of the golf club. The housing may include a mechanism to store information related to a specific amount of the cord extended from the housing, and an identifying device (or signaling device) to identify when the golf club is in a desired position based on the stored information.

24 Claims, 5 Drawing Sheets

U.S. PATENT DOCUMENTS

| | | | | |
|---|---|---|---|---|
| 6,863,616 | B2 | 3/2005 | Snyder et al. | |
| 6,966,519 | B2 | 11/2005 | Salentine et al. | |
| 7,021,140 | B2 | 4/2006 | Perkins | |
| 7,101,287 | B1 | 9/2006 | Wagner | |
| 7,134,968 | B1 * | 11/2006 | Pryor | 473/257 |
| 2003/0073492 | A1 | 4/2003 | Tosaki et al. | |
| 2003/0109324 | A1 * | 6/2003 | Novotny | 473/257 |
| 2004/0097296 | A1 | 5/2004 | Snyder et al. | |
| 2004/0229708 | A9 * | 11/2004 | Novotny | 473/257 |
| 2005/0261073 | A1 | 11/2005 | Farrington et al. | |
| 2006/0063600 | A1 | 3/2006 | Grober | |
| 2006/0084516 | A1 | 4/2006 | Eyestone et al. | |
| 2006/0111197 | A1 | 5/2006 | Yamamoto et al. | |

* cited by examiner

FIG. 5
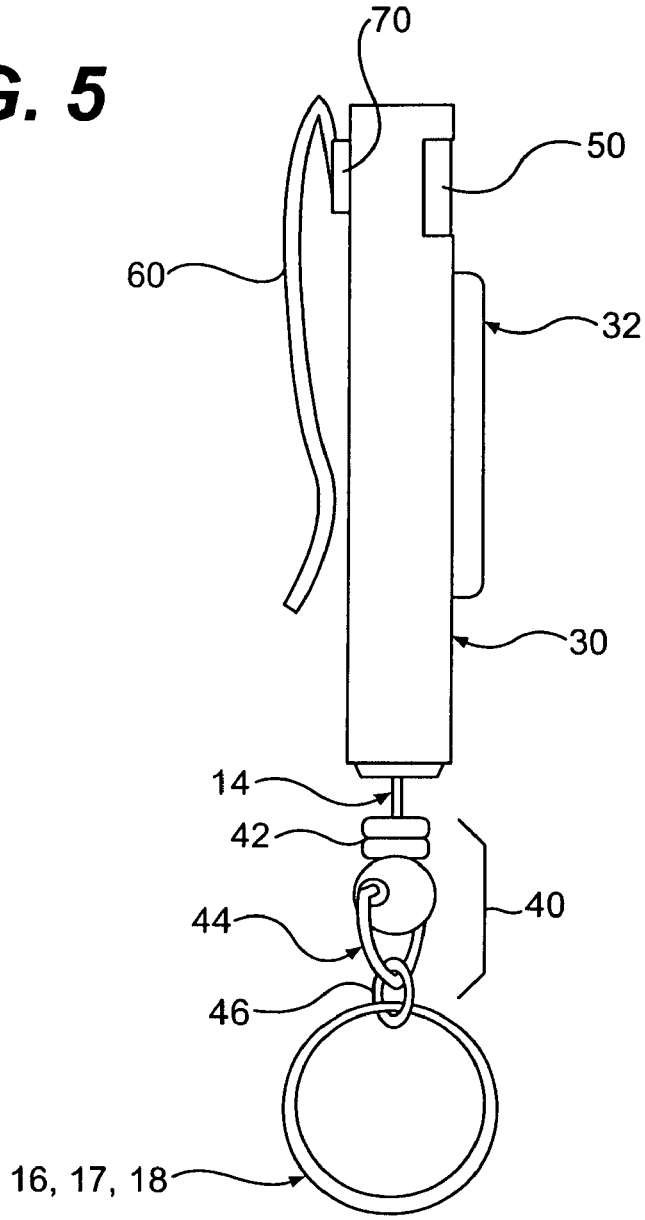
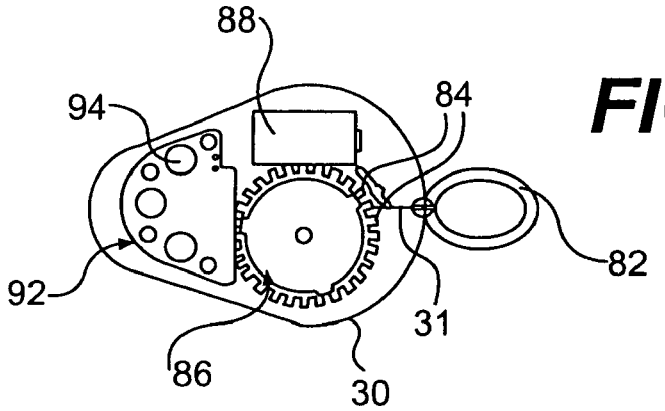
FIG. 6

GOLF SWING TRAINING DEVICE

This application claims priority from U.S. Non-provisional Application No. 60/898,399, filed Jan. 31, 2007, the subject matter of which is incorporated herein by reference.

BACKGROUND

1. Field

Embodiments of the present invention may relate to a device to train and/or aid a golfer when performing a swing (or stroke) of a golf club or other apparatus.

2. Background

In golf, a swing of a golf club may be an important aspect of the game. The golf swing involves at least an addressing of the golf club with the golf ball, a backswing of the golf club to a specific backswing point (or position) and a forward swing of the golf club from the specific backswing point to hit the golf ball.

The backswing of the golf club to a specific position is often based on a desired distance to hit the golf ball. In other words, a golfer may take a larger backswing for a further shot or a golfer may take a shorter backswing for a shorter shot. In order to take a proper or desired amount of backswing, golfers often take practice swings prior to hitting the golf ball (during an actual swing). These practice swings include the golfer mentally determining and/or remembering how far back to take a backswing.

BRIEF DESCRIPTION OF THE DRAWINGS

Embodiments of the present invention may be described in detail with reference to the following drawings in which like reference numerals refer to like elements and wherein:

FIG. 5 shows a side view of a swing training device according to an example embodiment of the present invention; and FIG. 6 shows a swing training device according to an example embodiment of the present invention.

DETAILED DESCRIPTION

Embodiments of the present invention may relate to a swing training device to aid golfers in performing golf swings. The swing training device may also be referred to as the Automatic Swing Training device (or TAST device). The swing training device may also be applicable to other sports. More particularly, embodiments of the present invention relate to a swing training device that allows a golfer to take a backswing to a desired position/point and/or a desired amount or length of a backswing. The desired position of the backswing may be determined previously such as during a practice backswing. The swing training device is able to inform the golfer (e.g. through an audible sound, through a visual display and/or by not allowing the cord to further extend) that the backswing has reached the desired position and/or desired amount of a backswing. This may allow the user to perform a golf swing having a desired backswing.

Figure 1B:
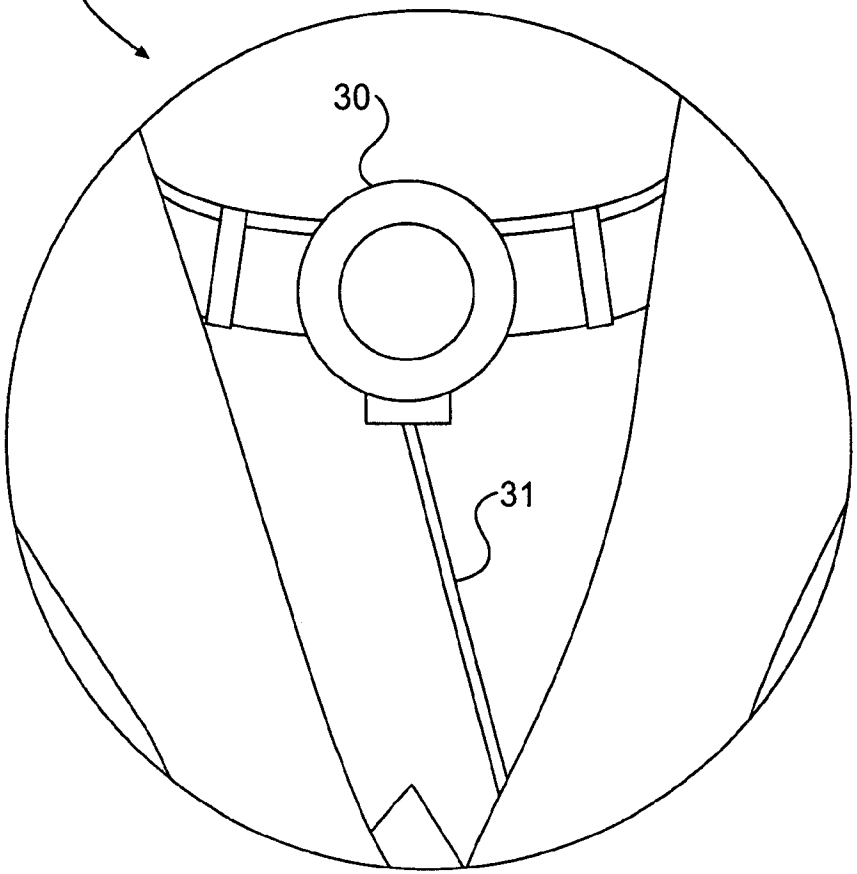
FIG. 1B shows an enlarged view of section 10 of FIG. 1A.
Figure 1A:
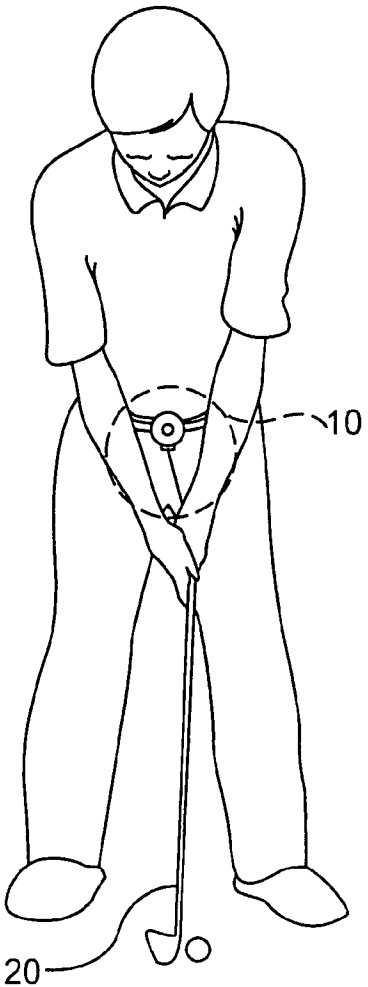
FIG. 1A shows a golfer having a golf swing training device according to an example embodiment of the present invention.

FIG. 1A shows a golfer having a golf swing training device according to an example embodiment of the present invention. Other embodiments and configurations are also within the scope of the present invention. More specifically, FIG. 1A shows a golfer holding a golf club 20 in a position of addressing a golf ball with the golf club. The golf club 20 may be coupled (or connected) to the golf swing training device shown within section 10. The golf swing training device may also be coupled (or connected) to a hand or a finger of the golfer.

FIG. 1B shows an enlarged view of the section 10 in which the swing training device is also attached to a belt (or pants) of the golfer. The swing training device may attach to items other than the belt of the golfer, such as the pants of the golfer or to a harness-like device, for example.

As shown in FIG. 1B, the swing training device may include a housing 30 and a cord 31 (or flexible member) that extends from the housing 30 and connects to the golf club 20, a hand of the golfer and/or a finger of the golfer, for example. Embodiments may hereafter refer to element 31 as a cord (and/or a flexible member or a pull cord). The cord 31 may be made of nylon, cotton, fish line, metal, etc. The cord 31 may also be considered a flexible member, a cable and/or a line. The cord 31 may also be coupled to a finger loop that loops around the golfer's finger. As one example, the loop may be a polyurethane finger loop.

During a backswing, a golfer's hand and the golf club both move relative to an initial position (i.e., relative to a position in which the golf club addresses the golf ball.) Since one end of the cord 31 is attached (or connected) to the hand or the finger of the golfer (or to the club), movement of the golfer's hand (and the club) during the backswing may extract (or extend) the cord 31 from the housing 30. The other end of the cord 31 may be attached to the housing 30 so that the cord 31 does not easily separate from the housing 30. The housing 30 may include a retracting mechanism to retract the cord 31 back into the housing 30 when the golfer returns the golf club back close to the golf ball (i.e., back to the initial position). Stated differently, the retracting mechanism retracts the cord 31 back into the housing 30 when a distance between the golfer's hand (and the club) and the housing 30 lessens or when the cord 31 becomes disconnected from the golfer's hand (or the golf club). Accordingly, the cord 31 may be extracted (or extended) from the housing 30 and may be retracted back into the housing 30. An amount of the cord 31 that is extracted from the housing 30 may be determined.

As one example, the retracting mechanism may include a double acting pull cord drum around which the cord is provided. The cord 31 may extend from the housing 30 and from around the drum when the cord is pulled by the user (such as in a backswing). The drum may also retract the cord back into the housing based on rotational force provided by a constant force coil spring provided in the housing. Other retracting mechanism may also be provided.

Figure 2B:
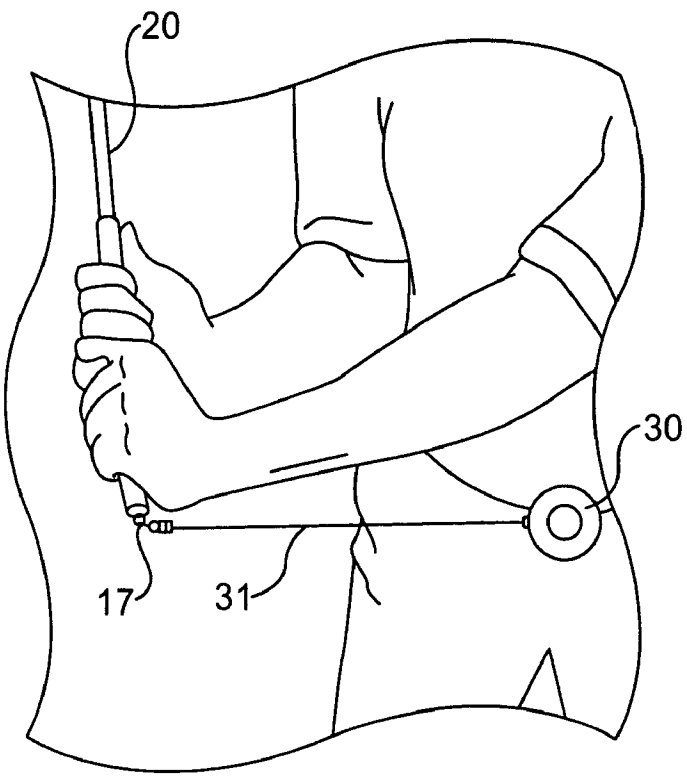
FIG. 2B shows a swing training device coupled to a butt end of a golf club according to an example embodiment of the present invention.
Figure 2A:
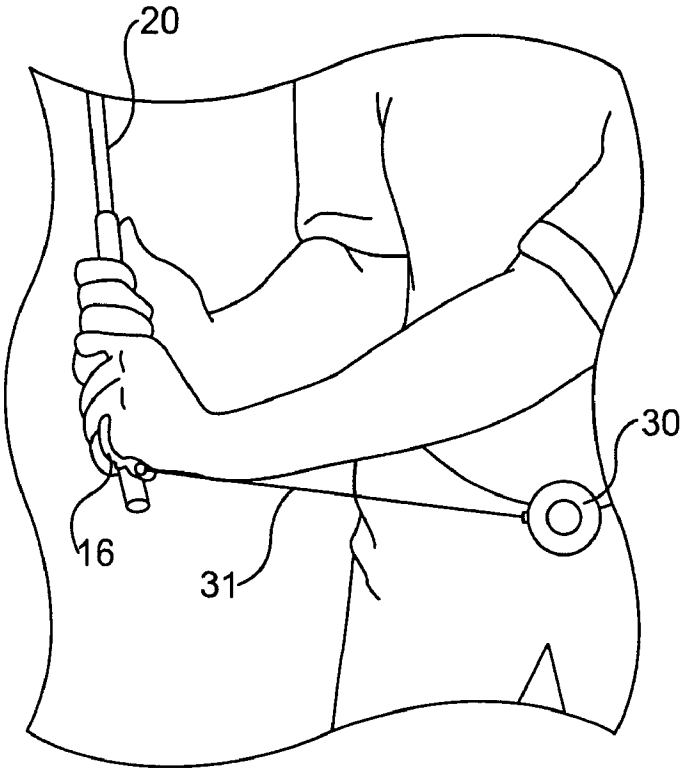
FIG. 2A shows a swing training device coupled to a golfer's finger according to an example embodiment of the present invention.

FIG. 2A shows a swing training device coupled to a golfer's finger according to an example embodiment of the present invention. Other embodiments and configurations are also within the scope of the present invention. More specifically, FIG. 2A shows that the swing training device further includes a connecting device 16 that is connected (or coupled) to one end of the cord 31. The connecting device 16 may attach to a finger of the golfer such as when the golfer desires to use the swing training device. The connecting device 16 shown in FIG. 2A may be a ring or loop to be provided on the golfer's finger (and/or around the golf club). FIG. 2A specifically shows the connecting device 16 as a ring (or loop) around a pinky of the golfer's left hand. Other types of connecting members and/or mechanism to couple with the cord 31 are also within the scope of the present invention.

FIG. 2B shows a swing training device coupled to a butt end of a golf club according to an example embodiment of the present invention. Other embodiments and configurations are also within the scope of the present invention. More specifically, FIG. 2B shows that the swing training device further includes a connecting device 17 that is coupled to one end of the cord 31. The connecting device 17 may also attach (or connect) to a butt end of the golf club 20 and/or to a tee (or other device) at a butt end of the golf club 20.

During use, a golfer may take a practice backswing to a desired backswing position. The desired backswing position may be determined/desired based on a distance that the golfer desires to hit a golf ball during an actual swing. Upon reaching the desired backswing position, the swing training device may store, program, maintain and/or identify information regarding the desired backswing position. This information may correspond to an amount of the cord 31 that has been extracted (or extended) from the housing 30 during the practice backswing to the desired backswing position. This information may be provided within an electronic device (such as memory) or within a mechanical device of the housing 30.

After performing the practice swing, the golfer may then perform an actual swing at the golf ball (i.e., to hit the golf ball). In order to accomplish this, using the swing training device, the golfer may execute a backswing to the desired backswing position and subsequently hit the golf ball when swinging the golf club 20. During the backswing, the golfer may be informed by the swing training device of the desired backswing position by an audible sound, a visual indicator or by feel of the cord 31 (based on a resistance of extracting/retracting the cord 31). This indication may inform the golfer to stop backswing (or backward) movement of the golf club 20 since the desired backswing position has been reached. The golfer may also be informed by the swing training device of the desired backswing position by the swing training device not allowing the cord 31 to be extracted any more from the housing 30. Upon reaching the desired backswing position, the golfer may swing the golf club 20 forward to hit the golf ball. The swing training device allows the golfer to take a backswing to a desired backswing position.

More specifically) the swing training device operates such that when the golfer takes a practice backswing as shown in FIG. 2A, the cord 31 extends from or is extracted from the housing 30 to a length that is dictated by the backswing of the golfer. When the golfer reaches the desired backswing position, the cord 31 has extended a specific length from the housing 30. The specific length is indicative of the golfer's desired backswing for a future backswing (e.g. during an actual swing/stroke). At the desired backswing position in the practice backswing, the golfer may depress a button or other mechanism on the housing 30 so as to store, program, maintain and/or identify information related to the specific length of the cord 31 that has been extracted or extended from the housing 30. This information may be used in a subsequent backswing such as when the golfer would be actually hitting a golf ball. Because the swing training device has information to perform a desired backswing, the swing training device may audibly and/or physically inform the golfer when the golf club has again reached the desired backswing position. That is, during an actual swing, when the golf club 20 has reached the desired backswing position, the golfer may then perform a forward swing and hit the golf ball.

Embodiments of the present invention are also applicable to storing, programming, maintaining and/or identifying the information by techniques other than depressing a button. For example, a golfer may speak a specific voice command that is recognizable by the swing training device. The information may be stored, programmed, maintained and/or identified based on the voice command.

The swing training device may include photo-interrupters within the housing. The photo-interrupters may sense rotation of the rotating drum (discussed above) by sensing teeth of the drum. The photo-interrupters (and processor) may therefore determine a distance in which the cord 31 was pulled (as well as a direction of rotation of the drum).

The swing training device allows a golfer to store, program, maintain and/or identify information related to a desired backswing. This information may be stored, programmed, maintained and/or identified during a practice swing and then used during an actual swing at the golf ball. The information may be stored, programmed, maintained and/or identified at other time periods such as during an actual swing and/or a plurality of actual swings (e.g. an average swing). The swing training device may also include electronic components to store specific information related to a desired backswing. For example, this information may be programmed into a memory (or memory device) to allow the device to store, program, maintain and/or identify the information. Accordingly, embodiments of the present invention allow the golfer to appropriately store, program, maintain and/or identify information relating to a backswing using the training device. This information may be used during an actual swing to enable a golfer to take a backswing to a specific position. Embodiments of the present invention are also applicable to storing, programming, maintaining and/or identifying information of more than one backswing.

Figure 3B:
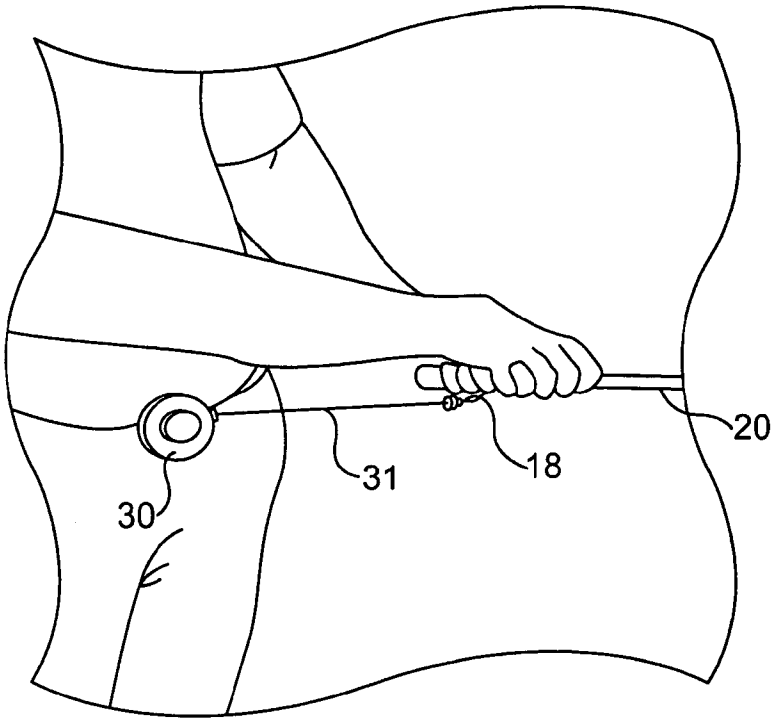
FIGS. 3A and 3B show a swing training device coupled to a golf club according to an example embodiment of the present invention.
Figure 3A:
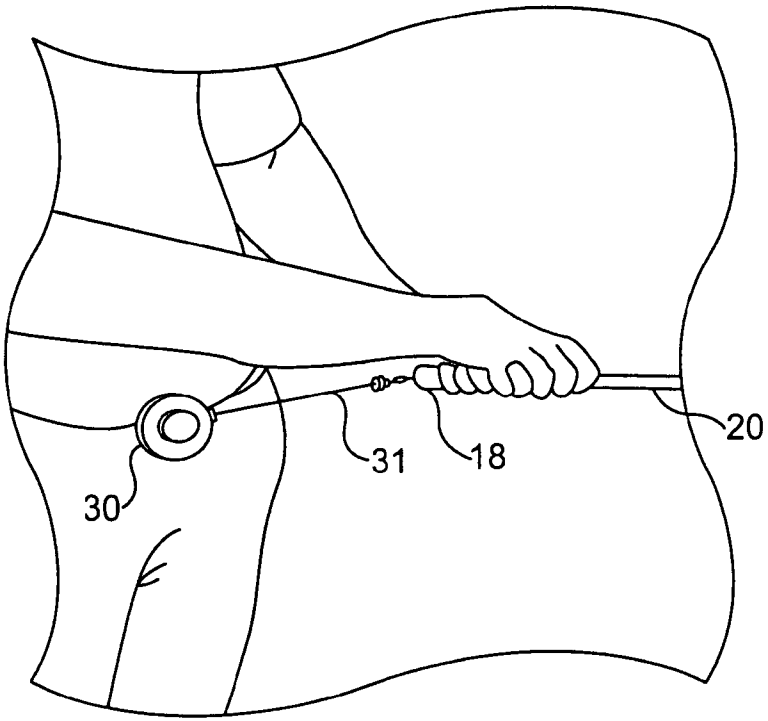

FIGS. 3A and 3B show a swing training device coupled to a golf club according to an example embodiment of the present invention. Other embodiments and configurations are also within the scope of the present invention. More specifically, FIG. 3A shows the swing training device includes a connecting device 18 that is coupled to one end of the cord 31. The connecting device 18 may attach to a butt end of the golf club 20 as shown in FIG. 3A. As another example, the golfer may insert a golf tee (or other device) into the butt end of the golf club 20 and then attach or connect the connecting device 18 to the golf tee (or other device).

FIG. 3B shows the connecting device 18 attached to an area of the golf grip of the golf club 20. The swing training device in FIGS. 3A and 3B may operate in a similar manner as discussed above so as to allow a user to store, program, maintain and/or identify information of a backswing and subsequently use that information to provide a better backswing.

Figure 4:
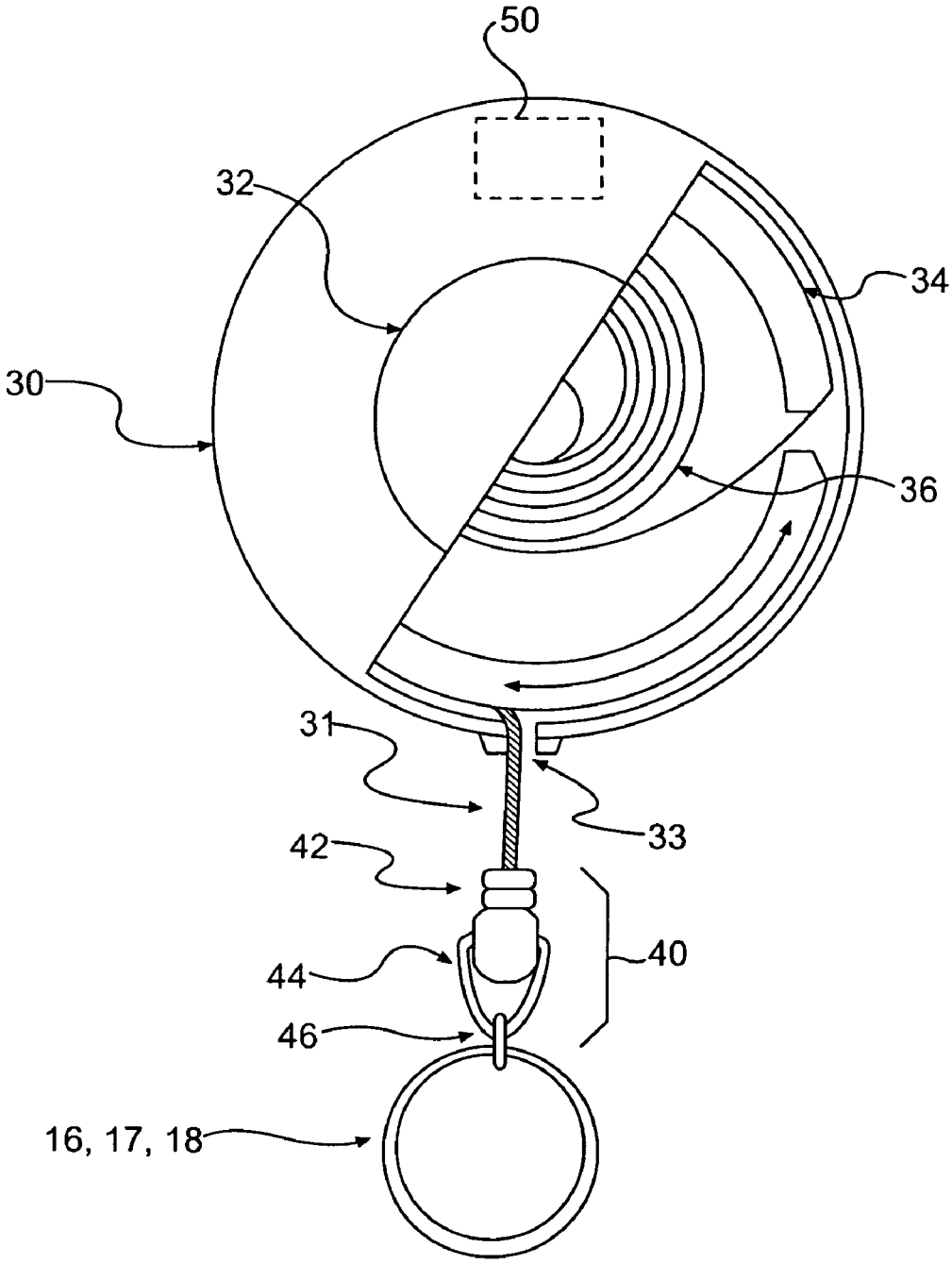
FIG. 4 shows a swing training device according to an example embodiment of the present invention.

FIG. 4 shows a swing training device according to an example embodiment of the present invention. Other embodiments and configurations are also within the scope of the present invention. More specifically, the swing training device may include the housing 30 to house or store the cord 31 such as when the cord 31 is retracted. The cord 31 may be housed in the housing in a coiled manner about a metal spring coil 36, for example. One end of the cord 31 may be attached to the housing 30 (e.g. at a central area) to prevent the cord 31 from being released from the housing 30. The housing 30 may also include a guide 34 and the spring coil 36 to guide the coil 31 when retracting into the housing 30 and to guide the coil 31 when extending or extracting outside of the housing 30 through an aperture 33. The housing 30 may also include a diaphragm 32 (or button) that may be engaged (or depressed) by the golfer so as to store, program, maintain and/or identify information related to a specific length of the cord 31 that has been extracted or extended from the housing 30. This information is indicative of a desired backswing level. For example, a golfer may depress the diaphragm 32 when a specific amount of cord 31 has been extracted or extended from the housing 30.

FIG. 4 also shows that the swing training device includes a swing identifying device 50 to provide an audible noise, for example, when the cord 31 is extracted from the housing 30 a specific amount based on the previously identified information relating to the backswing. The swing identifying device 50 may also provide a visual indication when the cord 31 is extracted from the housing 30 by the specific amount. The swing identifying device 50 may also display an expected distance that a golfer may hit a golf club at that extended amount of the cord 31 (based on previous data). Still further, the swing identifying device 50 may also provide resistance to the cord 31 or stop the extraction of the cord 31 when the cord 31 is extracted from the housing 30 by the specific amount. Accordingly, the swing identifying device 50 may identify when the golf club 20 is in a desired position.

The information related to the desired backswing may be stored in an electronic component such as a memory. The information may also be stored by mechanical means. For example, the depressing of the diaphragm 32 may cause portions of the cord 31 within the housing 30 to move from one position to another (e.g. from one spring coil to another spring coil). The retracted portion of the cord 31 may be provided on one of the two spring coils and the remaining portion of the cord 31 may be provided on another one of the two spring coils. A mechanical device to perform these operations is considered to have stored, programmed, maintained and/or identified information related to a desired backswing.

The housing 30 may be of a circular shape, a square shape or other shape. The housing 30, the diaphragm 32 and the guide 34 may be formed of plastic, although other materials may also be used.

FIG. 4 also shows that the swing training device includes an attachment mechanism 40 to attach the connecting device 16 (or 17 or 18) to the cord 31. The attachment mechanism 40 may include components such as a swivel 42, a ring (or loop 44) and a clamp 46. The attachment mechanism 40 may be considered part of the cord 31.

FIG. 5 shows a side view of a swing training device according to an example embodiment of the present invention. Other embodiments and configuration are also within the scope of the present invention. More specifically, FIG. 5 shows a clip 60 (or clasp) that may be provided on a back surface of the housing 30. The clip 60 may attach to a golfer's belt, pants and/or other device. The housing 30 may also include a swivel 70 provided on the back surface of the housing 30 to allow the housing 30 to swivel in a circular manner relative to the clip 60 based on a player's range of motion (such as when the golfer takes a backswing).

FIG. 6 shows a swing training device according to an example embodiment of the present invention. Other embodiments and configurations are also within the scope of the present invention. FIG. 6 shows components that may be provided within the housing 30 as well as the cord 31 and a connecting device (such as a finger loop 82) to connect to a user's pinky finger. The components may include a double acting pull cord drum 86 and photo-interrupters 84 coupled to (or mounted on) a printed circuit board (not shown). The photo-interrupters 84 may be provided about the drum 86 to sense teeth of the drum 86 as the drum rotates about a central axis. A power source 88 (such as a 3-volt battery) may be provided within the housing 30. The power source 88 may include a device to store a charge, such as from an AC voltage source. Still further, a printed circuit board 92 may also be provided within the housing 30 and include a programmable memory controller and/or a memory device to perform various operations as discussed above, such as storing, programming, maintaining and/or identifying information.

Various buttons 96 (or keys) may also be provided. The buttons 96 may be coupled to the printed circuit board 92. The buttons 96 may be exterior to the housing 31 to allow the user to input information, obtain information or program information. For example, the buttons 96 may include three memory buttons to store or obtain three different distances relating to the cord 31 being extracted from the housing 30. Other numbers of memory buttons (or function control buttons) may also be provided. The golfer may select a first one of the memory buttons to select (or store) a first amount of cord to be extracted. This first amount corresponds to a first backswing amount. The golfer may select a second one of the memory buttons to select (or store) a second amount of backswing. This second amount corresponds to a second backswing amount. Additionally, the golfer may select a third one of the memory buttons to select (or store) a third amount of cord to be extracted. This third amount corresponds to a third backswing amount. Other function buttons may also be provided such as power on/off buttons.

A programmable memory coupled to (or mounted on) the printed circuit board 92 may store different pull cord distance settings (such as for the memory buttons). The memory controller and/or memory may also signal an audible device to provide a signal from a speaker (not shown) when a specific distance of the cord 31 has been extracted from the housing 30. For example, the memory controller may activate a memory distance for each of the stored amounts of cord to be extracted (i.e. the stored distance of a backswing).

The swing training device may further store information related to different distances to hit a golf ball using a specific club. The information may have been previously entered into the memory. A user interface may allow a user to select a club or distance and then obtain information regarding the backswing based on the entered information.

The swing training device may further include input/output ports to allow various external devices to couple to the swing training device. For example, ports may be provided on the housing to allow connection to a computer, a PDA, an MP3 player/receiver, etc.

Embodiments of the present invention are applicable to the swing training device to identify when the golf club has reached a desired position relative to a starting position based on stored information. The golfer may be informed by an audible sound, by a visual indicator, by a change in resistance of the cord being extended from outside of the housing and/or by the cord being denied an ability to extend any further. Other techniques of informing the golfer are also within the scope of the present invention.

Embodiments of the present invention have a capability to extend a cord from a housing and then to set an indicator identifying the set position. The cord may then be rewound (or retracted) into the housing. The swing training device may then have a set distance so that each time the golfer swings, the cord will extend from the housing and stop (or indicate by an audible noise or visual indicator) at the pre-measured or pre-set point and then rewind back into the housing time after time until the golfer chooses a new distance.

While the above description relates to a swing training device for use with a golf club, embodiments of the present invention may also be applicable to other types of sports equipment (e.g. tennis, hockey) and or other types of equipment that involve a swing and/or a stroke.

Embodiments of the present invention are also applicable to a user entering information into the swing training device by electronic means. For example, a golfer may enter information into the swing training device through a key pad or by downloading the information into a memory of the swing training device. This information may correspond to a desired backswing for different desired distances that a golfer desires to hit a golf ball. The desired backswing information may correspond to a specific length that the cord 31 should extend from the housing 30. This information may also be altered by the golfer or by way of a processor (such as based on a golfer's actual swing). As another example, a golfer may further enter information into the swing training device relating to an actual distance that a golf ball travels. This information may then be used to alter the stored information based on the specific backswing position and the actual distance of the golf ball. A processor may also implement an averaging technique or other technique to determine a desired backswing position based on previous performances of hitting the golf ball.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A golf training device comprising:

a cord;

a housing to house the cord when the cord is in a retracted state and to allow the cord to extend therefrom;

a memory provided in the housing;

a user input device, operable by a user, to store information in the memory, wherein the information corresponds to a specific amount of the cord extended from the housing at a time when the user input device is operated by the user; and an audible device to audibly identify when the cord extends the specific amount from the housing based on the stored information in the memory.

2. The golf training device of claim 1, further comprising a visual indicator device to visually identify when the cord extends the specific amount from the housing.

3. The golf training device of claim 1, further comprising a resistance mechanism to change a resistance of the cord being extended from the housing.

4. The golf training device of claim 3, wherein the resistance mechanism stops the cord from being further extended when the cord has extended the specific amount from the housing.

5. The golf training device of claim 1, wherein the user input device comprises a button.

6. The golf training device of claim 1, wherein the memory to store first information corresponding to a first amount of the cord extended from the housing at a first time when the user input device is operated by the user, and the memory to store second information corresponding to a second amount of the cord extended from the housing at a second time when the user input device is operated by the user.

7. The golf training device of claim 1, further comprising a determining device to determine when the specific amount of the cord has been extended from the housing.

8. A golf training device comprising:

a cord;

a connecting device coupled to one end of the cord, the connecting device to connect to a golf club, to a golfer's hand or to a golfer's finger;

a housing to house the cord when the cord is in a retracted state and to allow the cord to extend therefrom;

a memory device;

a button provided on the housing to store information into the memory device upon depression of the button, wherein the information corresponds to a specific amount of the cord extended from the housing, and a swing identifying device to audibly identify when the golf club is in a desired position based on the information stored in the memory device.

9. The golf training device of claim 8, wherein the swing identifying device includes a visual indicator device to visually indicate when the golf club is in the desired position based on the information stored in the memory device.

10. The golf training device of claim 8, wherein the swing identifying device includes a resistance mechanism to change a resistance of the cord being extended from the housing.

11. The golf training device of claim 10, wherein the resistance mechanism stops the cord from being further extended when the golf club reaches the desired position.

12. The golf training device of claim 8, wherein the connecting device comprises a loop.

13. The golf training device of claim 8, wherein the button comprises a diaphragm.

14. The golf training device of claim 8, wherein the button is a button of a mechanical mechanism.

15. The golf training device of claim 8, wherein the button is a button of an electronic mechanism.

16. The golf training device of claim 8, wherein the memory device to store first information corresponding to a first amount of the cord extended from the housing at a first time when the button is depressed by a user, and the memory to store second information corresponding to a second amount of the cord extended from the housing at a second time when the button is depressed by the user.

17. The golf training device of claim 8, further comprising a determining device to determine when the specific amount of the cord has been extended from the housing.

18. A golf device comprising:

a cord;

a drum device to hold the cord and retract the cord, the drum device including teeth about a perimeter of a drum;

a sensing device to sense rotation of the drum based on the teeth of the drum;

a memory device;

a user input device to store information into the memory device, wherein the information corresponds to an amount of the cord extracted from the the drum device; and a signaling device to audibly identify when an amount of the cord extended from the drum device corresponds to the information stored in the memory device.

19. The golf device of claim 18, further comprising a loop coupled to one end of the cord.

20. The golf device of claim 18, wherein the user input device stores information into the memory device regarding a plurality of amounts of the cord extracted from the drum device.

21. The golf device of claim 18, wherein the sensing device comprises photo-interrupters.

22. The golf device of claim 18, wherein the user input device comprises a button.

23. The golf device of claim 18, wherein the memory device to store first information corresponding to a first amount of the cord extracted from the drum device at a first time when the user input device is operated by the user, and the memory device to store second information corresponding to a second amount of the cord extracted from the drum device at a second time when the user input device is operated by the user.

24. The golf device of claim 18, further comprising a determining device to determine when an amount of the cord that has been extracted from the drum device corresponds to the information stored in the memory device.

* * * * *